United States Patent [19]

Turner, Jr.

[11] 4,285,184

[45] Aug. 25, 1981

[54] METHOD OF SOUND-PROOF WINDOW CONSTRUCTION FOR BUILDING STRUCTURES

[76] Inventor: Ralph L. Turner, Jr., 1235 Regency Pl., San Jose, Calif. 95129

[21] Appl. No.: 72,409

[22] Filed: Sep. 4, 1979

[51] Int. Cl.[3] ..... E06B 1/04

[52] U.S. Cl. ..... 52/741; 52/210; 52/404

[58] Field of Search ..... 52/741, 210, 204, 404, 52/144, 275, 788, 481, 309.9, 309.11, 208, 289

[56] References Cited

U.S. PATENT DOCUMENTS

| | | | |
|---|---|---|---|
| 2,235,811 | 3/1941 | Davison | 52/210 X |
| 2,263,919 | 11/1941 | Darragh, Jr. | 52/144 X |
| 2,716,261 | 8/1955 | Huffman | 52/210 |
| 3,305,993 | 2/1967 | Nelsson | 52/404 X |
| 3,611,653 | 10/1971 | Zinn | 52/407 X |
| 3,899,861 | 8/1975 | Brown | 52/788 |

*Primary Examiner*—Carl D. Friedman
*Attorney, Agent, or Firm*—Owen L. Lamb

[57] ABSTRACT

A method of constructing a building with a sound-proof window therein. A double-skinned exterior wall is constructed having an outer structure of sheathing supported by vertical studs and an inner structure of sheathing supported by vertical studs which are separate from the studs supporting the outer sheathing, such that an air space is created therebetween. A first window is glazed in an opening in the outer sheathing and a second window is glazed in an opening in the inner sheathing, such that the second window is in tandem with the first window. The air space between the inner and outer structures is then filled with a sound-absorbing insulating material, such that the air space provides a sound-absorbing resonant cavity.

4 Claims, 4 Drawing Figures

METHOD OF SOUND-PROOF WINDOW CONSTRUCTION FOR BUILDING STRUCTURES

BACKGROUND OF THE INVENTION

The invention relates to building structures and more particularly to a method of constructing double-skinned exterior building walls with double-glazed windows therein.

DESCRIPTION OF THE PRIOR ART

Double-glazed window units are utilized in the construction of building structures for both thermal insulation and to reduce sound entering through the window opening. Two or more spaced sheets of glass are held in a framework. In order to reduce vibration and acoustic coupling, rubber gaskets are utilized around the sheets of glass. Furthermore, acoustic material is commonly utilized to line the inner recesses around the inner perimeter of the frame. It is common practice to seal the window assembly so that it is air-tight, thus reducing the formation of moisture on the inner surfaces. An example of this type of window is that shown in Brown U.S. Pat. No. 3,899,861.

With the foregoing type of commercially-available window units, the width of the double-skinned exterior walls must be made equal to the width of the window unit. This places a restriction on the width of the wall, and thus the amount of sound that the wall will absorb.

Window construction for cabins of aircraft to reduce sound and vibration have taken a different approach to that in the building industry. For example, in the Darragh, Jr. U.S. Pat. No. 2,263,919, which issued Nov. 25, 1941, the following approach is taken. The outer shell of the airplane is provided with an opening therein into which a transparent window pane is inserted and held in by clamps. A similar window pane is inserted in an opening in the inner cabin shell by means of clamps in a manner similar to that for the outer shell. Because of the unique structure of the body of the airplane, the inner and outer shells are maintained in a spaced relationship with respect to each other by means of resilient metal brackets which attach the inner cabin to the outer load-carrying shell. As pointed out in this patent, it is important that the air space between the panes be not completely confined, so that any vibration of the outer pane would be transmitted to the inner pane and thus would result in a source of noise. Thus, spacing strips made of a soft, porous material through which air can pass, are used to define the inner periphery of the space between the panes.

Since the inner shell of an airplane is not a load-carrying structure, it can be made of a very resilient material and need only be attached at a few points to the outer, load-carrying shell. While this construction technique may be advantageous to reducing noise in an aircraft, the technique cannot be used in constructing a building structure, wherein the walls must be vertical, and must be able to withstand substantial loads.

As can be seen from the foregoing, it is very desirable to be able to construct building walls with windows glazed therein that have the same highly effective noise-reducing characteristics of windows found in airplane structures.

It is therefore an object of the present invention to provide an improved method of constructing exterior building walls to provide double-glazed windows with substantially better noise-reducing properties.

SUMMARY OF THE INVENTION

Briefly, the above object is accomplished in accordance with the invention by the following method of constructing an exterior building wall. The method comprises the steps of first constructing a double-skinned wall having an outer structure of sheathing supported by vertical studs and an inner structure of sheathing supported by vertical studs which are separate from the vertical studs supporting the outer sheathing. The result is inner and outer structures comprised of separate support elements with a space therebetween.

Second, a first window is glazed in an opening in the outer sheathing.

Third, a second window is glazed in an opening in the inner sheathing such that the second window is in tandem with the first window.

Fourth, the space between the inner structure and the outer structure is insulated with a sound-absorbing insulating material such that the space provides a sound-absorbing resonant cavity to sound waves impinging upon the first window.

The invention has the advantage of being simple to construct, because the window structure does not utilize a single unit, double-paned window. On the contrary, ordinary single-pane windows are utilized, thus reducing cost and complexity.

A further advantage of this method is that the wall structure can be made of any desired thickness because the thickness is not limited by the size of a double-pane window unit. The outer wall structure and the inner wall structure are separate and can be made any distance apart in width. This allows the width to be chosen to damp frequencies within a desired frequency range. The space between the walls thus can be designed to be a Helmholtz cavity resonator.

BRIEF DESCRIPTION OF THE DRAWING

The foregoing and other objects, features, and advantages of the invention will be apparent from the following detailed description of preferred embodiments of the invention, as illustrated in the accompanying drawings wherein.

DESCRIPTION (The invention is described in Disclosure Document No. 064385 filed on Sept. 22, 1977.)

Figure 1:
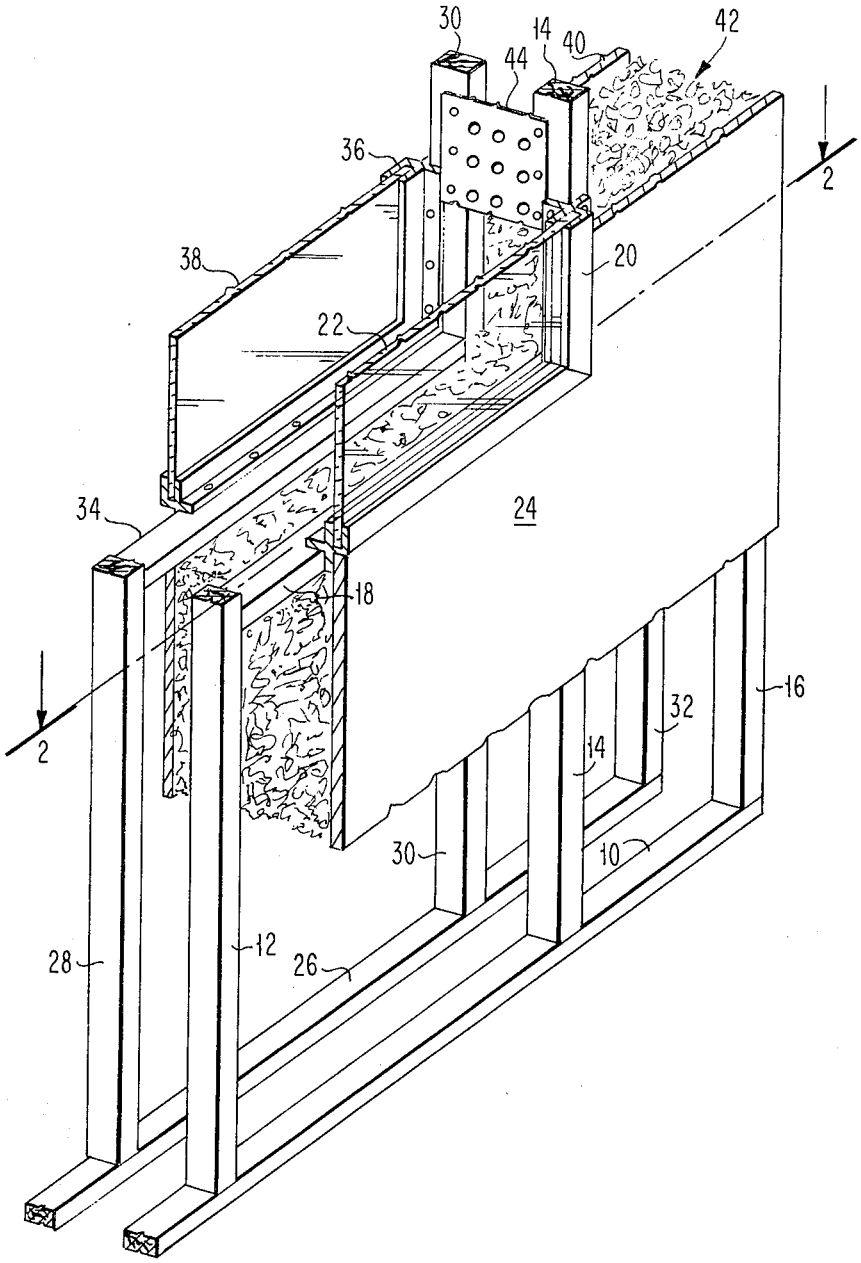
FIG. 1 is a perspective sectional view of a building structure constructed in accordance with the method of the invention.
Figure 2:
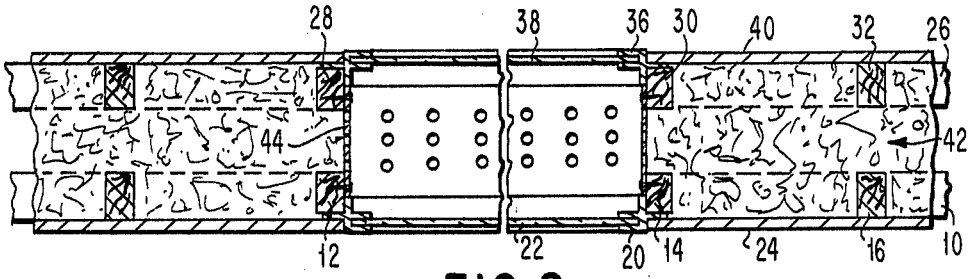
FIG. 2 is a top-view section taken along the dotted lines shown in FIG. 1.
Figure 3:
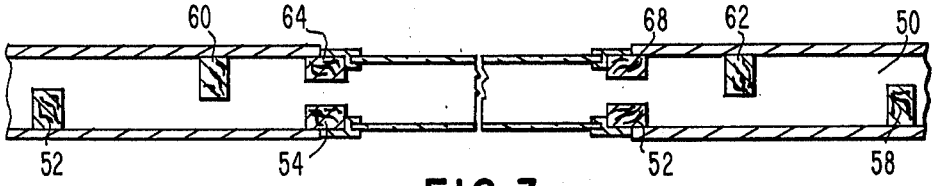
FIG. 3 is a top-view of a second embodiment of the invention.

Referring now to FIGS. 1 and 2, a building constructed in accordance with the method of the present invention is shown. An outer structure is constructed by first laying a support plate (10) on the foundation surface. This plate may be a 2×4, or alternatively a 2×6, in which event an alternate stud structure may be utilized, as shown in FIG. 3. Vertical studs (12, 14, 16) are attached to the plate (10) and to the roofing structure (not shown). A horizontal framing member (18) is provided to frame in a window opening. A similar member (not shown) is used to define the upper portion of the opening. Next, a window frame (20) with a glass pane (22) clamped therein is secured to the framing members which define the window opening. An outer sheathing (24) is then attached to the vertical studs (12, 14, and 16). Alternatively, the outer sheathing (24) may be attached to the vertical studs before the window frame is glazed in the outer structure.

In a similar manner, the inner structure is constructed. That is, a plate (26) is secured to the foundation, and vertical studs (28, 30, 32) are attached thereto and to the roofing members. As with the outer structure, the inner window opening is framed-in utilizing the horizontal framing member (34) and a similar member (not shown) defining the upper part of the window opening. A second window frame (36) with a glass pane (38) clamped therein is set in the inner-window opening. The inner structure is finished by attaching an inner sheathing (40) to the vertical studs. Alternatively, the inner sheathing (40) may be attached to the vertical studs before the window frame is glazed in the inner structure. The space between the inner and outer sheathing is then filled with a thermal insulating material (42), which also has sound-absorbing characteristics.

For sake of appearance, and to prevent objects from falling between the window spaces, a guard (44) is attached to one of the studs (30). The guard is made of porous material, such as metal or plastic, with holes drilled therein, or a thin acoustical cloth which allows air to pass freely therethrough. If a nonresilient guard is utilized, it should be attached to only one of the studs (30), around the periphery in order that it does not provide a sound-flanking path to noise contingent upon the outer surface of the building.

The sound transmission loss at various frequencies will be dependent upon the depth, height, and width of the cavity formed between the windows and the type and density of insulation utilized, in addition to the size of the holes in the perforated guard.

Referring now to FIG. 3, an alternative embodiment of the invention is shown. In this embodiment, a single 2×6 plate (50) is utilized to support both the inner and outer structures. 2×4 studs (52 and 58) support the outer structure, and staggered studs (60, 62) support the inner structure. Further studs (54, 56, 64, 68) define the vertical frame of the window opening. The remainder of the structure is similar to that described with respect to FIG. 1.

Figure 4:
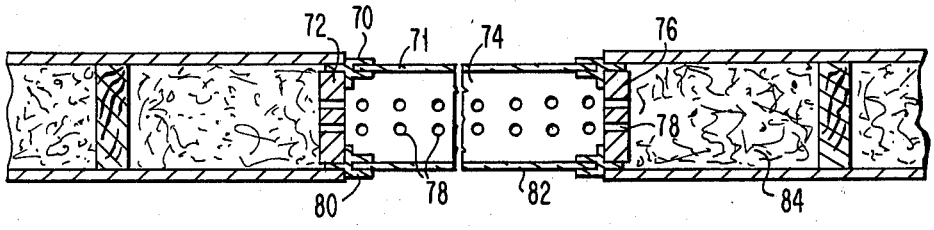
FIG. 4 is a top-view of a third embodiment of the invention.

The foregoing describes the method of constructing a new building structure. It should be understood that the principles of the present invention can also be applied to modify existing structures. Referring now to FIG. 4, an existing building modified in accordance with the invention is shown. An existing building has a single outer window frame (70) with a glass pane (71) clamped therein, glazed in a window opening. Framing studs (72, 74, 76) frame-in around the window opening. In order to modify this structure to provide noise reduction, it is necessary to first create an opening in the studs (72, 74, 76) to the wall cavity. This is done by drilling holes (78) in the framing studs all around the periphery of the window opening. Next an inner window frame (80) with a glass pane (82) clamped therein, is set in the inner window opening. The preexisting insulation (84) in the wall cavity now provides a sound-absorbing cavity, access to which being made possible through the holes (78).

While the invention has been particularly shown and described with reference to preferred embodiments thereof, it will be understood by those skilled in the art that the foregoing and other changes in form and detail may be made therein without departing from the spirit and scope of the invention.

What is claimed is:

1. The method of constructing a building structure with a window therein, wherein said structure provides noise reduction, comprising the steps of:

(a) constructing a double-skinned wall comprised of outer sheathing supported by first vertical studs and inner sheathing supported by second vertical studs, which second studs are separate from said first studs supporting said outer sheathing, such that outer and inner structures are created of separate elements with a space therebetween;

(b) glazing a first window in an opening in said outer structure;

(c) glazing a second window in an opening in said inner structure, such that said second window is in tandem with said first window, and (d) insulating said space between said inner and said outer structures with a sound-absorbing insulating material, such that said space provides a sound-absorbing cavity to sound waves impinging upon said first window.

2. The method in accordance with claim 1 wherein said constructing step (a) further comprises the steps of laying a first support plate by which said first vertical studs are supported and laying a second support plate by which said second vertical studs are supported.

3. The method in accordance with claim 1 wherein said constructing step (a) further comprises the steps of first laying a support plate, and second placing said first and second vertical studs in a staggered relationship with respect to each other on said support plate such that said vertical studs support said inner and outer sheathings without interference between said first and second studs.

4. The method in accordance with claim 1 wherein said glazing step (a) further comprises the step of constructing a window frame around an opening in said sheathing, and attaching a perforated guard plate to said window frame in such a manner as to prevent objects from entering said space between the inner and outer structures, while allowing air to freely pass therethrough.

* * * * *